US006348871B1

(12) United States Patent
Tanguay et al.

(10) Patent No.: US 6,348,871 B1
(45) **Date of Patent: *Feb. 19, 2002**

(54) ADVERSE CONDITION DETECTION AND NOTIFICATION APPARATUS

(75) Inventors: William P. Tanguay, DuPage County; Thomas W. Kondziolka; Brian J. Althoff, both of Cook County, all of IL (US)

(73) Assignee: Maple Chase, Downers Grove, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/394,750

(22) Filed: Sep. 13, 1999

(51) Int. Cl.[7] ..... G08B 17/10

(52) U.S. Cl. ..... 340/628; 340/577; 340/584; 340/632; 340/693; 340/629; 340/514

(58) Field of Search ..... 340/628, 629, 340/630, 825.44, 691.3, 429, 426, 514, 516, 577, 584, 693, 691.1, 691.5, 692

(56) References Cited

U.S. PATENT DOCUMENTS 3,873,921 A * 3/1975 Petrinec ..... 325/396
3,990,075 A * 11/1976 Schmitz et al. ..... 340/420
4,032,909 A * 6/1977 Boyce ..... 340/214
4,063,227 A 12/1977 Peterson ..... 340/237
4,652,859 A * 3/1987 Van Wienen ..... 340/503
4,688,021 A 8/1987 Buck et al. ..... 340/521
4,965,556 A * 10/1990 Brodecki et al. ..... 340/628
5,157,375 A * 10/1992 Drori ..... 340/429
5,422,629 A 6/1995 Minnis ..... 340/630
5,565,852 A 10/1996 Peltier et al. ..... 340/362
5,568,129 A * 10/1996 Sisselman et al. ..... 340/628
5,589,824 A * 12/1996 Lynch ..... 340/628
5,726,634 A 3/1998 Hess et al. ..... 340/628
5,783,989 A * 7/1998 Issa et al. ..... 340/426
5,825,407 A * 10/1998 Cowe et al. ..... 348/6

* cited by examiner

*Primary Examiner*—Jeffery Nofsass
*Assistant Examiner*—Hung Nguyen
(74) *Attorney, Agent, or Firm*—Terrence Martin; Jules J. Morris; Sean D. Detweiler

(57) ABSTRACT

The present invention provides an adverse condition detection apparatus that enables a user to test the apparatus in close proximity without having to endure fully operational alarm noise. In one embodiment, the apparatus includes a detector, a transducer, and a test system. The detector provides an adverse condition signal in response to detecting an adverse condition (e.g., smoke). The transducer is operably connected to the detector for receiving the adverse condition signal. The transducer generates an operational alarm in response to receiving the adverse condition signal when the detector detects the adverse condition. The test system is operably connected to the transducer and causes it to generate a test alarm in response to a user activating the test system. However, the test alarm, at least initially, is lower in audibility than the operational alarm.

21 Claims, 4 Drawing Sheets

Detected Smoke

Test System Activated

ADVERSE CONDITION DETECTION AND NOTIFICATION APPARATUS

TECHNICAL FIELD OF THE INVENTION

The present invention generally relates to adverse condition detectors such as smoke detectors. In particular, the present invention relates to an improved test system for an adverse condition detector. Background of the Invention.

BACKGROUND OF THE INVENTION

Adverse condition detectors (e.g., smoke detectors) have been recognized as useful products in providing an early warning where ambient smoke increases to an undesirable level. When the predetermined level of smoke has been sensed, the detectors often generate an audible and/or a visual alarm.

Two types of detectors are available in the retail market. One type is the so-called ionization type. A second type is the so-called photoelectric type.

Smoke alarms, also known as ionization smoke alarms and photoelectric smoke alarms, are extremely effective at reducing deaths from fires. In an effort to maintain this effectiveness over many years, such smoke alarms include a manual test switch. Manufacturers and fire officials recommend that occupants test the smoke alarm's operation periodically, e.g. weekly, by pressing the manual test switch and observing if the smoke alarm produces a perceptible indication that the alarm is operational, usually by sounding an audible alarm. In addition, battery powered models of smoke alarms also include a battery power monitoring circuit that automatically sounds the audible alarm with a unique sound if a low battery power condition occurs.

Unfortunately, lack of maintenance or improper maintenance may not alert the user that their smoke alarm is inoperative, and consequently it may not respond when the ambient smoke level increases to an undesirable level that is indicative of a dangerous fire condition. This can occur where the owner of the smoke detector has not maintained the detector in proper working condition by failing to check the operability of the smoke detector with the manual test switch on a regular basis as suggested.

One such automatic system is disclosed in Brodecki, et. al. U.S. Pat. No. 4,965,556 assigned to the assignee of the present invention.

One reason why owners do not check the operability of smoke detectors at regular intervals results from the fact that these smoke detectors produce audible alarms that can be physically painful when the user is in close proximity to the smoke detector. Solutions to this problem have involved utilizing special switches that can be activated from a distance with, e.g, a broom or a flashlight. Unfortunately, such solutions are not convenient, and alarms continue to go untested.

Accordingly, what is needed in the art is a convenient, effective solution for testing an adverse condition detector such as a smoke detector.

SUMMARY OF THE INVENTION

The present invention provides an adverse condition detection apparatus that enables a user to test the apparatus in close proximity without having to endure fully operational alarm signals, often perceived as painful noise by users. In one embodiment, the apparatus includes a detector, a transducer, and a test system. The detector provides an adverse condition signal in response to detecting an adverse condition (e.g., smoke). The transducer is operably connected to the detector for receiving the adverse condition signal. The transducer generates an operational alarm in response to receiving the adverse condition signal when the detector detects the adverse condition. The test system is operably connected to the transducer and causes it to generate a test alarm in response to a user activating the test system. However, the test alarm, at least initially, is lower in audibility than the operational alarm.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
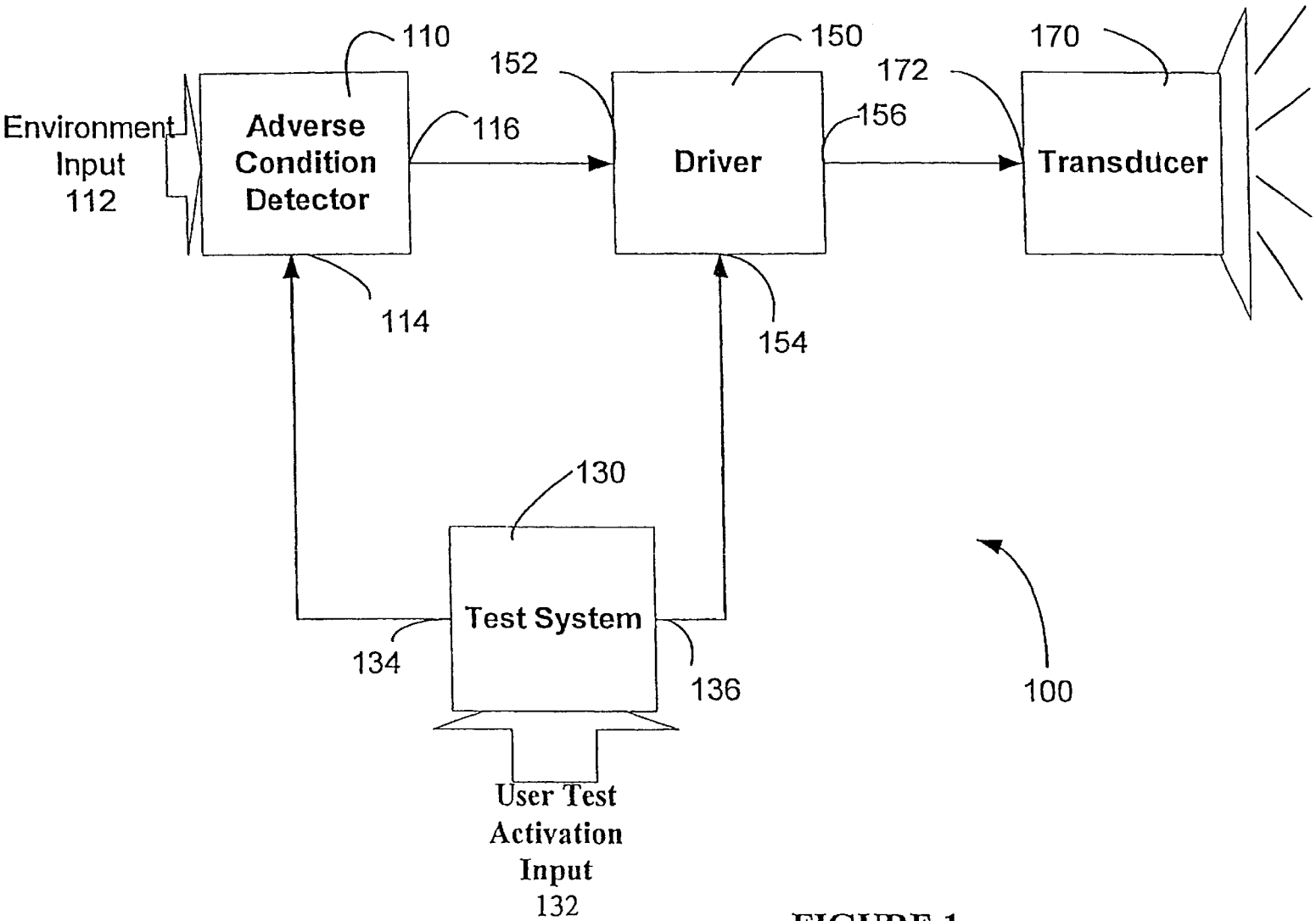
FIG. 1 is a block diagram of one embodiment of an adverse condition detection apparatus of the present invention.

FIG. 1 shows a block diagram of an adverse condition detection apparatus 100 of the present invention. In the depicted embodiment, apparatus 100 comprises an adverse condition detector 110, test system 130, driver 150, and alert transducer 170. The adverse condition detector (or "detector") 110 includes environment input 112, test activation input 114, and adverse condition output 116. The driver 150 has driver input 152 electrically connected to the adverse condition output 116, a test control input 154, and a driver output 156. The test system 130 has a user activation input 132, a test activation output 134 electrically connected to the detector's test activation input 114, and a driver control output 136 electrically connected to the test control input 154 of the driver 150. Finally, the transducer 170 has drive input 172 electrically connected to the driver output 156 of the driver 150.

Generally speaking, the detector 110 may include any type of a device for detecting an adverse condition for a given environment. For example, a detector could be a smoke detector (e.g., ionization, photo-electric) for detecting smoke indicating the presence of a fire. Other detectors could include but are not limited to carbon monoxide detectors, aerosol detectors, gas detectors including combustible, toxic, and pollution gas detectors, heat detectors and the like.

An alert transducer ("transducer") 170 may be any suitable device for alerting a user that an adverse condition has been detected. Such an alert transducer 170 could include but is not limited to a horn, a buzzer, siren, and a flashing light. In one embodiment, alert transducer 170 comprises a piezoelectric resonant horn, which is a highly-efficient device capable of producing extremely loud (85 dB) alarms when driven by a relatively small drive signal.

The driver 150 may be any suitable circuit or circuit combination that is capable of (1) operably driving the alert transducer 170 to generate an operational alarm when the detector detects an adverse condition, and (2) causing (e.g., driving) the alert transducer to produce a scaled-down (quieter) alarm in response to the test system 130 being activated by a user. In turn, the test system 130 may be any suitable device, circuit or combination thereof for testing the adverse condition apparatus including causing the transducer to generate, at least initially, a scaled-down alarm in response to the test system being activated.

In operation, two different conditions will cause the alert transducer 170 to generate an alarm. The first condition is the detection of an adverse condition, which causes the generation of an operational alarm. The second condition is a user's activation of the test system 130, which causes the generation of the scaled-down alarm.

In operation, when an adverse condition such as a smoke-causing fire occurs (detector 110 being a smoke detector), smoke enters apparatus 100 through environment input 112 and accumulates in the detector 110. Once a sufficient amount of smoke accumulates within detector 110, the detector generates an adverse condition signal that is outputted at the adverse condition output 116. In response to receiving this signal through detector input 152, the driver generates a drive signal that is capable of operably driving the alert transducer to generate the operational alarm. This drive signal is outputted through drive output 156. Finally, the alert transducer 170 receives the drive signal through drive input 172, which causes the transducer to generate the operational alarm. For example, when the transducer 170 is a piezoelectric horn, the driver (with resonant feedback from the piezoelectric horn) generates an operable horn modulation envelope (e.g., 3200 Hz.) modulated over a static or fluctuating pulse train signal (e.g., 9 V, 1 Hz., 50% duty cycle).

For testing the alarm apparatus 100, a user activates the test system 130 through user test activation input 132 (such as by depressing and holding a switch). In one embodiment of the present invention, in response to being activated, the test system 130 (1) induces the detector 110 to generate an adverse condition signal, which as discussed above, ultimately causes the driver to generate a drive signal for driving alert transducer 170, and (2) controls (or causes) the driver to attenuate (at least initially) the drive signal. That is, it causes the driver to generate a "scaled-down" or attenuated, drive signal, which results in the alert transducer generating a scaled-down, or attenuated alarm. For example, with the aforelmentioned drive signal example, the same horn modulation envelope could be generated but with a reduced amplitude. In this manner, a user may conveniently test the apparatus and confirm that at least the transducer is operable without enduring discomfort, e.g., from a painfully loud, operational alarm.

Figure 2:
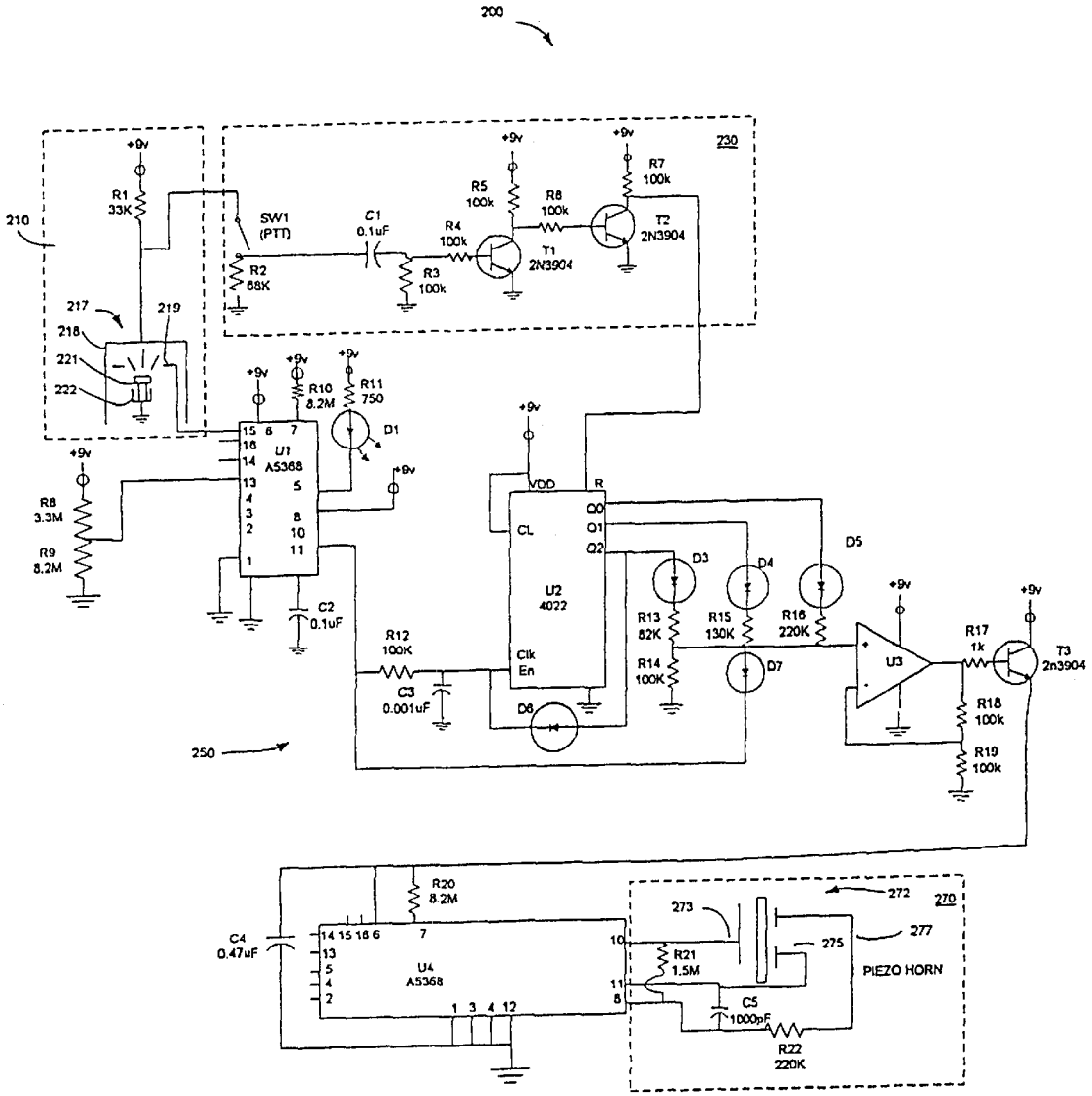
FIG. 2 is an electrical schematic of one embodiment of the detection apparatus of FIG. 1.
Figure 3A:
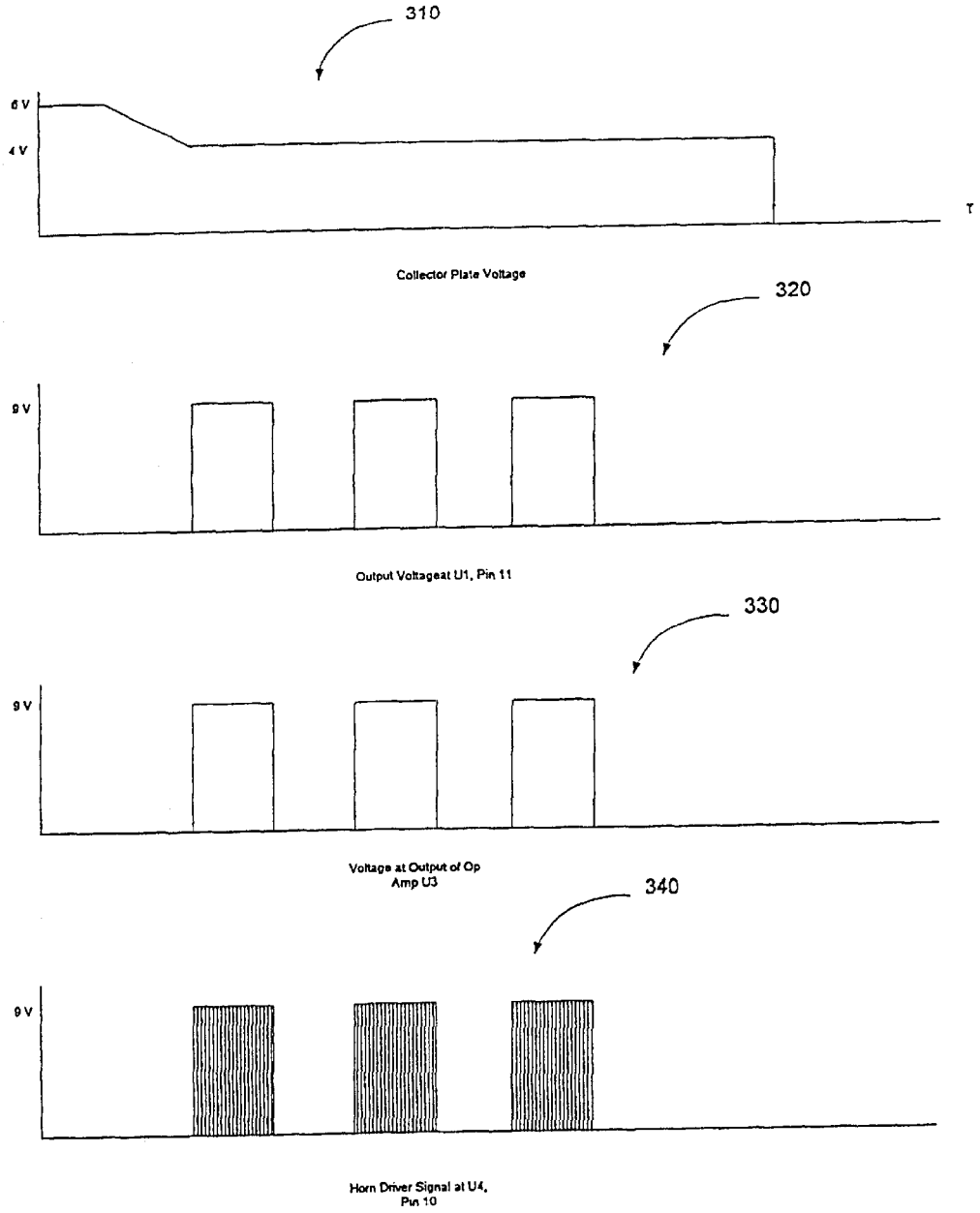
FIG. 3A is a signal diagram showing various signals within the apparatus of FIG. 2 when the adverse condition is being detected.
Figure 3B:
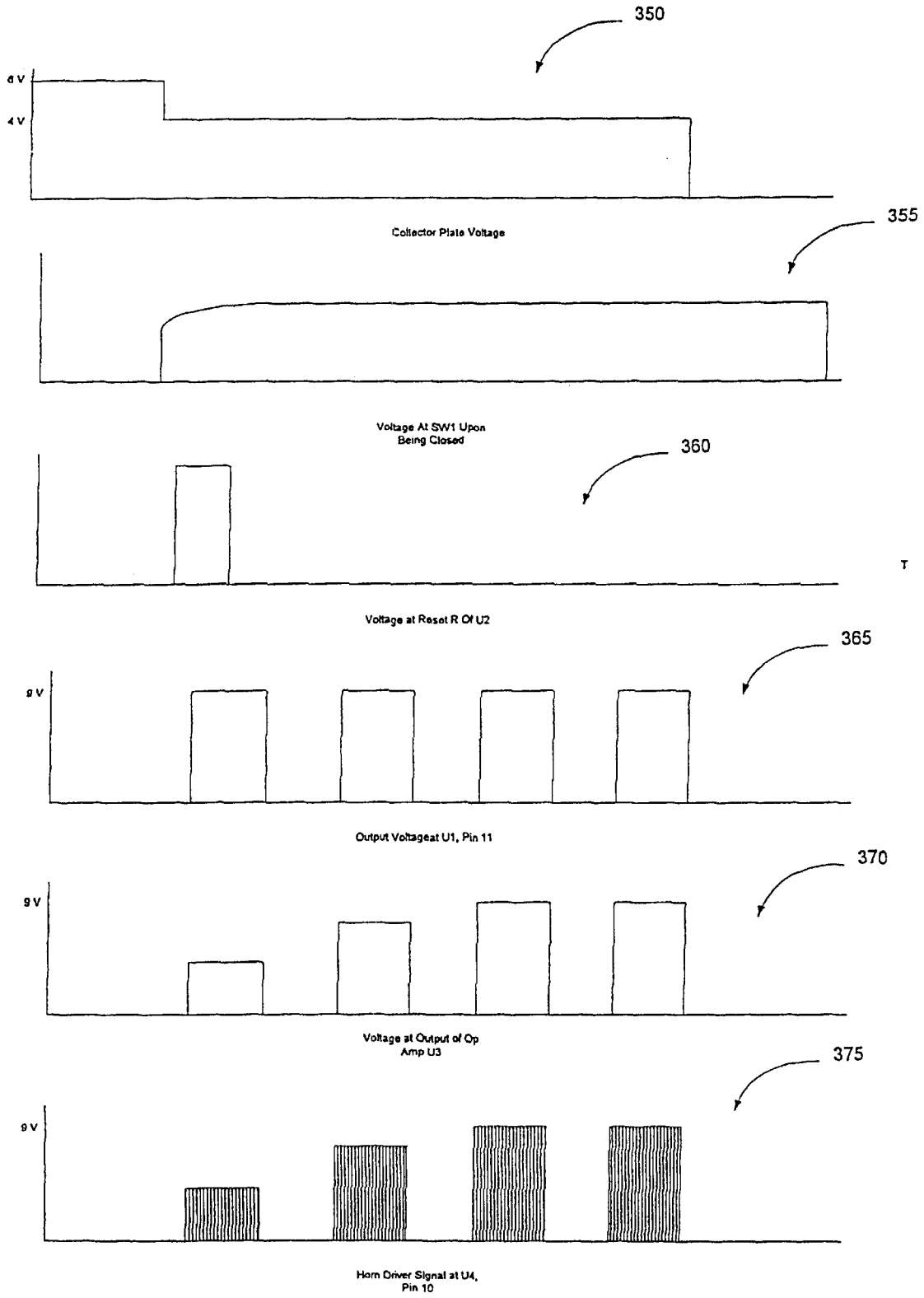
FIG. 3B is a signal diagram showing various signals within the apparatus of FIG. 2 when the apparatus is being tested.

Reference is now made to FIGS. 2, 3A, and 3B. FIG. 2 shows an electrical schematic of one embodiment of a smoke detector apparatus 200 of the present invention. FIG. 3A shows relevant operational signals when smoke is being detected, and FIG. 3B shows the same relevant signals but when the test system is being activated.

It should be understood that the invention is clearly not limited to the specific components, values, and configurations shown in FIG. 2. After reading the following description, persons of ordinary skill will recognize that the present invention could be implemented in countless ways. However, for ease of understanding, one particular embodiment of the present invention will now be described.

With reference to FIG. 2, the smoke detector apparatus 200 generally comprises smoke detector circuit 210, test system circuit 230, driver circuit 250 and piezo-electric horn transducer 270.

The smoke detector circuit 210 comprises an ionization-type smoke detector 217 and a resistor R1. The ionization-type detector 217 comprises chamber 218, collector plate 219, isotope source 221, and source holder 222. Collector plate 219 serves as an adverse condition output. The isotope source 221 is connected to ground via source plate 222. The resistor R1 is connected between a 9 V source and the chamber 218. The isotope source 221 nominally emits alpha particles in the space formed between the source 221 and chamber 218. The chamber is vented for receiving smoke when it is present. The alpha particles ionize the air in the chamber providing a conductive path between the chamber 218 and the physically connected source 221 and source holder 222, with the conductive path intercepting the collector plate 219. Thus, when no smoke is present, the collector plate 219 has a first predetermined voltage value. With the 9 V power source connected to chamber 218, in one embodiment, this first predetermined value is about 6 V. The introduction of smoke into the ionization chamber increases the resistance between the collector plate 219 and ionization chamber 218, as compared to a proportionally smaller resistance increase between the collector plate 219 and the physically joined source 221 and source holder 222, which subsequently causes the voltage at the collector plate 219 to decrease in proportion to the amount of smoke in the chamber. In the depicted embodiment, this voltage decreases to about 4 V when a sufficient amount of smoke has entered the chamber. Thus, in this embodiment, the adverse condition signal at the adverse condition output (collector plate 219) changes from about 6 V to about 4 V when the detector circuit 210 detects a sufficient amount of smoke indicating the presence of a fire.

The test system circuit 230 comprises push-to-test switch ("PTT") SW1, resistors R2–R7, capacitor C1, and bipolar junction transistors T1 and T2. Resistor R2 is connected between ground and one side of switch SW1. The other side of SW1 is connected to the ionization chamber 218 of the detector circuit 210. On one of its sides, capacitor C1 is connected to the node between R2 and SW1. At its other side, C1 is connected to a junction formed between R3 and R4, which are connected to one another. The other side of R3 is connected to ground, and the other side of R4 is connected to the base of T1. T1's emitter is connected to ground. Resistor R5 is connected between a 9 V source and the collector of T1. At one end, R6 is also connected to T1's collector, and at its other end, R6 is connected to the base of T2. Resistor R7 is connected between a 9 V source and the collector of T2. Finally, T2's emitter is connected to ground. The PTT switch SW1 serves as a user activation input. The R2 side of SW1 serves as a test activation output, and the collector output of T2 serves as a driver control output.

When the normally open switch SW1 is open, the test system does not affect the operation of the detector apparatus 200. However, when SW1 is closed, the voltage at chamber 218 drops from a nominal 9 (nine) volts to approximately 6 (six) volts, and this voltage change furthermore causes the voltage at collector plate 219 to drop from approximately 6 (six) volts to approximately 4 (four) volts. R1 and R2 are selected so that this resulting voltage at collector plate 219 is less than or operably close to the voltage at collector plate 219 when a reasonable level of smoke is detected in the chamber 218. In this manner, the test system circuit 230 induces the detector to generate an adverse condition signal when SW1 is being depressed.

The combination of T1, R4, and R5 form a simple inverting amplifier. Likewise, the combination of T2, R6, and R7 do the same. Thus, the overall combination of T1, T2, and R4–R7 form a non-inverting amplifier for buffering a pulse (which is formed across C1 when SW1 is initially closed) from the C1/R3 junction to the drive control output at T2's collector. As will be addressed below, this buffered pulse causes the driver circuit 250 to at least initially drive the piezoelectric horn 270 at a scaled-down (more tolerable) level.

The driver circuit 250 comprises ionization smoke alarm integrated circuit chips U1, U4 (implemented with A5368 ASICs, available from Allegro, Inc. of Worcester, Mass.), 4022 divide-by-eight counter U2, operational amplifier U3, BJT transistor T3, capacitors C2–C4, resistors R8–R20, LED D1, and diodes D3–D7. (For brevity sake, only the operationally significant components will be discussed. That is, standard pin connections and filter capacitors such as C4 will not be addressed.)

Collector plate 219 (which serves as the adverse condition signal output) of detector circuit 210 is connected to input 15 of U1. Resistors R8 and R9 are connected in series between a 9 V source and ground, and in conjunction with internal resistors of U1 connected in a similar manner, serve as a voltage divider for dropping a voltage of about 4.8 V across reference pin 13 of U1. R11 and LED D1 are connected in series between a 9 V source and pin 5 of U1 for indicating that the 9 V source is operational. R10 serves to bias U1, while C2 sets the timebase for the periodic operation of U1 Output pin 11 of U1 is connected to clock enable input of U2 through R12, output pin 10 is not connected, and pin 8, normally the feedback input for a piezoelectric horn, is connected to 9 volts. Capacitor C3 is connected as a filter between U2 clock enable and ground. The collector of T2 (which functions as the test control output) is connected to the count reset pin R of counter U2. D6 is connected between counter output Q2 and the clock enable Clk En input. D3 and R13 are connected in series between output Q2 and the non-inverting input of op-amp U3. Likewise, D4 and R15 are connected in series between output Q1 and the non-inverting input of U3, and D5 and R16 are connected in series between output Q0 and the same non-inverting input of U3. R14 is connected between the non-inverting input and ground. In addition, D7 is connected between the non-inverting input and output pin 11 of U1. Providing negative feedback for op-amp U3, R18 is connected between U3's output and its inverting input. In addition, R19 is connected between the inverting input and ground. R17 is connected between U3's output and the base of BJT T3, with the collector connected to a 9 V source, and the emitter connected to the supply power inputs 6 and 7 (through R20) of U4.

Ionization smoke alarm chips U1, U4 each have output pins 10, 11, and input pin 8 for conventionally driving a resonant piezoelectric horn. Pin 8 is a resonant return line, and pins 10 and 11 provide the horn modulation envelope signals, which are pulse trains (e.g., 1 Hz., 50% duty cycle). The envelope signals are coincident, while the modulation signals to the piezoelectric horn are 180 degrees out of phase from one another. When a piezoelectric horn circuit is connected thereto (such as with horn circuit 270 connected to U4), a higher horn frequency (approximately 3200 Hz.) signal is modulated onto the pulse train for generating the audible alarm. Thus, the output at pins 10 and 11 of U1 will simply be a low frequency (e.g., 1 Hz.) pulse train because it is not driving a piezo horn, and because pin 8 is connected to 9 volts. Conversely, the output at pins 10, 11 of U4 provide an approximate 3200 Hz. alarm generation signal modulated onto the pulse train because these outputs are connected to the piezoelectric horn circuit 270, and because the input power to U4 is modulated by the envelope generated by U1 when an alarm condition exists.

Each ASIC chip U1 and U4 include an internal comparator for switching on/off the pulse train at pins 10 and 11. Pins 13 and 15 serve as the inputs for this comparator. When the voltage at pin 15 goes below the voltage at pin 13, the pulse train signal is activated. Conversely, when it is higher than the voltage at pin 13, the pulse train is turned off. Thus, when the output voltage from collector plate 219 goes below 4.8 V (which is the approximate voltage input at pin 13), such as when smoke is detected or when the PTT switch SW1 is depressed, the pulse train signal at pin 11 of U1 is generated. Likewise, when this voltage is above 4.8 V, such as when no smoke is present and when the switch is not being depressed, no signal is output from pin 11 at U1. The comparison inputs at pin 13 and pin 15 are not used in U4, as the only function of U4 is to properly cause the piezoelectric horn 270 to sound.

The divide-by-eight counter U2, unlike a conventional counter, outputs a High (or "1") only at one of its Q0–Q7 outputs at any given time. (Q3 through Q7 are not shown.) An active signal (e.g., low to high transition) at the reset pin causes a High (which approximates the supply voltage of 9 V) to be output at Q0 with Lows (0 V) at the other outputs. With the clock CL pin tied High, the counter counts upward on each falling edge of the clock signal at the Clk En input. This causes a high to successively be outputted from Q0 to Q1 and then from Q1 to Q2. Normally, this would proceed up through Q7 and roll back to Q0. However, with D6 connected between Q2 and Clk En, once a High is outputted onto Q2, a High is maintained at input Clk En. independent of the signal at pin 11 of U1, which causes the High to remain at Q2 until U2 is reset once more.

The combination of U3, R13–R16, R18, R19, and D3–D5 form a non-inverting amplifier having three distinct gains for the three significant outputs: Q0–Q2. From Q0 to the amplifier output, the amplifier has a gain of about 0.6. With respect to Q1, it has a gain of about 0.8, and from Q2 to the output, it has a gain of about 1.0. Thus, the smallest output at U3's output (about 5.2 V) occurs when Q0 is active; a larger output (about 7.2 V) occurs when Q1 is active, and the largest output (9 V) occurs when Q2 is active. This largest output corresponds to a full operational alarm.

The combination of transistor T3 and resistor R17 function as an emitter-follower driver for driving (powering) horn modulation envelope generator U4 with the output from U3. Although U4 is a conventional ionization smoke alarm chip, in the depicted embodiment, it is configured as only a piezoelectric horn driver.

The piezoelectric horn circuit 270 comprises R21, R22, C5, and piezoelectric horn 272 having drive inputs 273, 275 and resonant return output 277. Horn modulation outputs 10, 11 from U4 are connected to drive inputs 273 and 275, respectively. Likewise, return resonant input pin 8 of U4 is connected through R22 to the return resonant output 277 of horn 272. Finally, C5 is connected between the drive output at pin 11 and return input at pin 8 of U4, and R21 is connected between the drive output at pin 10 and return input at pin 8 of U4. At this point, the overall operation of apparatus 200 will be discussed.

FIG. 3A shows signals and signal relationships within apparatus 200 when smoke is detected. As smoke enters the ionization chamber 218 of detector 217, the voltage 310 at collector plate 219 is reduced from a first predetermined level of approximately 6 (six) volts to a second predetermined voltage of approximately 4 (four) volts, which is below the reference voltage at pin 13 of U1. Other voltages are possible for the second predetermined level, and the actual level is generally proportional to the density and the characteristic of combustion particles that have entered the chamber. Four volts is an example of one particular level of smoke. This causes the horn envelope pulse train (as shown at 320) to be outputted at U1, pin 11. U2 will nominally output a high at Q2. (It is assumed that the smoke detector apparatus 200 would be tested upon first start-up, or during periodic maintenance, and thus the counter would usually remain in the state defined by the condition where Q2 would be high.) With D6 holding this state (by holding the clock enable input High), an approximate 9 V pulse train (at 330) is provided at the op amp output of U3. This signal substantially mirrors the signal output from U1, pin 11. This is because diode D7 "shorts" out the voltage at the non-inverting input of U3 when the pulse train at U1, pin 11 is Low. The output of Q2 approximates the supply voltage, which in the depicted embodiment is 9 V. Thus, a pulse train signal having a magnitude of about 9 V is outputted from op amp U3.

The 9 V pulse train outputted from U3, and buffered by BJT T3 powers horn modulation chip U4. This causes the horn modulation envelope 340 at pins 8, 10, and 11 of U4 to track the counterpart signal output from U1. The generated horn modulation envelope 340 drives the piezoelectric horn 270 at a fully operational (e.g., 85 dB) level.

FIG. 3B shows relevant signals within apparatus 200 when the test system is activated for testing the apparatus. As switch SW1 is depressed, the voltage 350 at collector plate 219 is induced to fall below the threshold level at U1, pin 13. The depression of SW1 also causes the voltage 355 at SW1 to exponentially rise as capacitor C1 is being charged. This causes a voltage pulse to occur at R3. This results in a mirror pulse 360 being outputted from the collector at T2, which is the test control output. This pulse causes the divide-by-eight counter U2 to reset and output a High at Q0. Concurrently, with the collector plate voltage reduced (as SW1 is depressed), the horn pulse train signal is output from U1, pin 11. As pulses are applied to Clk En, the counter U2 counts upward until Q2 has a high at its output. Then D6 turns on and locks the counter at this state until reset once more from a subsequent SW1 depression. The signal that is generated at op amp U3 output is shown at 370. As can be seen, the voltage begins at the lowest (Q0) level and ramps upward to the maximum (Q2) level. This signal powers horn generator U4, which means that the horn modulation envelope signal 375 has a corresponding magnitude. This causes the horn to generate an alarm with a lower level of audibility for the first two pulses, which allows a user to test the apparatus 200 with the first pulse or two and then release the switch before a maximum alarm blast is produced. In another embodiment of the invention, R15 is made equal to R16 so that the first two alarm pulses are at equally lower levels of audibility. Thus, with the present invention, a user may easily test the alarm apparatus by depressing a switch and confirm that the alarm is functioning without having to endure at close range the painful operational alarm noise.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention.

For example, an adverse condition detection apparatus with a test system of the present invention could be implemented with any suitable circuitry. The test system may induce the driver to generate an adverse condition signal in order to test the apparatus, or it may directly initiate the driver to drive the alarm at a reduced level. In addition, the test system could be configured to cause the driver to generate a constant reduced alarm rather than a ramped up alarm. For that matter, the present invention can be used with any type of alarm signal such as a continuous signal or dynamic pulsed signal. A continuous ramp, as well as a pulsed ramp, could be used for a test alarm. Moreover, any suitable circuitry or component configuration could be used with the present invention. For example, the entire test system and driver could be implemented with a single ASIC. Accordingly, the appended claims are intended to include within their scope such processes, machines, manufacture, compositions of matter, means, methods, or steps.

We claim as follows:

1. An adverse condition notification apparatus, comprising:

(a) a detector for detecting an adverse condition, the detector providing an adverse condition signal responsive to detecting the adverse condition;

(b) a transducer operably connected to the detector for receiving the adverse condition signal, the transducer generating an operational alarm in response to receiving the adverse condition signal when the detector detects the adverse condition; and (c) a test system operably connected to the transducer to cause the transducer to generate an attenuated operational alarm in response to a user activating the test system, wherein the attenuated operational alarm comprises a series of alarm pulses including a first, second, and third alarm pulse, wherein the first alarm pulse is lower in audibility than the second alarm pulse and the second alarm pulse is lower in audibility than the third alarm pulse.

2. The apparatus of claim 1, wherein the test system is operably connected to the detector for inducing the adverse condition signal responsive to the test system being activated.

3. The apparatus of claim 2, further comprising a driver for driving the transducer, the driver being operably connected to the detector, test system, and transducer and wherein the adverse condition signal causes the driver to drive the transducer, wherein the test system causes the driver to generate the attenuated operational alarm.

4. The apparatus of claim 1, wherein the operational and attenuated operational alarms each comprise a series of alarm pulses including a first pulse, wherein the first attenuated operational alarm pulse is lower in audibility than the first operational alarm pulse.

5. The apparatus of claim 1, wherein the attenuated operational alarm comprises a series of alarm pulses including a first, second, and third alarm pulse, wherein the first and second alarm pulses have a substantially equal magnitude that is less than that of the third alarm pulse.

6. The apparatus of claim 1, wherein the detector is a smoke detector.

7. The apparatus of claim 7, wherein the smoke detector is an ionization type smoke detector having a sensing chamber that is connected to the test system, wherein the test system induces a voltage change at the collector when activated in order to induce the adverse condition signal.

8. The apparatus of claim 1, wherein the detector is a carbon monoxide detector.

9. The apparatus of claim 1, wherein the detector is a photoelectric type smoke detector.

10. The apparatus of claim 1, wherein the detector is a heat detector.

11. The apparatus of claim 1, wherein the transducer comprises a piezoelectric horn.

12. The apparatus of claim 1, wherein the test system comprises a switch for enabling the user to activate the test system.

13. The apparatus of claim 13, wherein the switch is a push-to-test switch.

14. A smoke detector apparatus, comprising:

(a) a detector having a detector output for providing a detection signal when a sufficient amount of smoke is detected;

(b) a driver operably connected to the detector for receiving from the detector the detection signal, the driver generating an alarm signal in response to receiving the detection signal;

(c) an alert transducer operably connected to the driver for receiving the alarm signal, wherein the alert transducer generates an operational alarm in response to receiving the alarm signal when the smoke is detected; and (d) a test system operably connected to the driver for causing the alert transducer to generate an attenuated operational alarm when the test system is being activated, wherein the attenuated operational alarm is, at least initially, not as loud as the operational alarm, wherein the attenuated operational alarm comprises a series of alarm pulses including a low audibility alarm pulse and at least one subsequent alarm pulse actuable after said low audibility pulse, said low audibility alarm pulse being lower in audibility than said subsequent alarm pulse and wherein said test system is operable to deactivate said attenuated operational alarm during operation of said low audibility alarm pulse and prior to activation of said subsequent alarm pulse.

15. The apparatus of claim 14, wherein the test system induces the detector to generate the detection signal when the test system is activated.

16. The apparatus of claim 15, wherein the alarm signal comprises a series of alarm pulses including a first alarm pulse, wherein the first alarm pulse for a an attenuated operational alarm is smaller than a first alarm pulse for an operational alarm.

17. The apparatus of claim 16, wherein the alert transducer is a piezoelectric horn.

18. The apparatus of claim 17, wherein the test system comprises a switch to enable a user to activate the test system.

19. The apparatus of claim 18, wherein the switch comprises a push-to-test switch.

20. A method for enabling a user to conveniently test an adverse detection apparatus, comprising:

(a) providing in the detection apparatus a test switch;

(b) providing in the apparatus an operational alarm that is activated when an adverse condition is detected;

(c) generating with the apparatus an attenuated operational alarm when the user activates the switch in order to confirm that the apparatus including a transducer generates the operational alarm is operational, whereby the attenuated operational alarm is lower in audibility than the operational alarm and comprises a plurality of alarm pulses, including a first alarm pulse that is lower in audibility than a subsequent alarm pulse, the attenuated operational alarm being de-actuable prior to activation of the subsequent alarm pulse.

21. An adverse condition notification apparatus, comprising:

(a) a detector for detecting an adverse condition, the detector providing an adverse condition signal responsive to detecting the adverse condition;

(b) a transducer operably connected to the detector for receiving the adverse condition signal, the transducer generating an operational alarm in response to receiving the adverse condition signal when the detector detects the adverse condition; and (c) a test system operably connected to the transducer to cause the transducer to generate an attenuated operational alarm in response to a user activating the test system, wherein the attenuated operational alarm comprises a series of alarm pulses including a first, second, and third alarm pulse, wherein the first and second alarm pulses have a substantially equal magnitude that is less than that of the third alarm pulse.

* * * * *